US010921745B2

(12) United States Patent
Kamei

(10) Patent No.: US 10,921,745 B2
(45) Date of Patent: Feb. 16, 2021

(54) IMAGE FORMING APPARATUS

(71) Applicant: CANON KABUSHIKI KAISHA, Tokyo (JP)

(72) Inventor: Yasuo Kamei, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/667,483

(22) Filed: Oct. 29, 2019

(65) Prior Publication Data

US 2020/0133190 A1 Apr. 30, 2020

(30) Foreign Application Priority Data

Oct. 29, 2018 (JP) ..... JP2018-202899

(51) Int. Cl.
*G03G 15/00* (2006.01)
*G03G 21/16* (2006.01)

(52) U.S. Cl.
CPC ..... *G03G 21/1647* (2013.01); *G03G 21/1619* (2013.01); *G03G 21/1652* (2013.01); *G03G 21/1666* (2013.01)

(58) Field of Classification Search
CPC ..... G03G 21/1619; G03G 21/1647; G03G 21/1652; G03G 21/1666; G03G 21/1867
See application file for complete search history.

(56) References Cited

U.S. PATENT DOCUMENTS 8,594,530 B2 * 11/2013 Sato ..... G03G 21/1633 399/107
9,069,324 B2 * 6/2015 Mori ..... G03G 21/1628

FOREIGN PATENT DOCUMENTS

JP 2012-144019 A 8/2012

* cited by examiner

*Primary Examiner* — Hoang X Ngo
(74) *Attorney, Agent, or Firm* — Venable LLP

(57) ABSTRACT

An image forming apparatus includes a main assembly and a drawer unit. The drawer unit includes a rotatable photosensitive drum, an optical print head, a relay substrate, a first wall portion, a second wall portion and a third wall portion continuously formed between an upstream end portion of the first wall portion and an upstream end portion of the second wall portion with respect to a drawing-out direction of the drawer unit from the main assembly. The relay substrate is provided on a surface of the third wall portion on an upstream side with respect to the drawing-out direction.

11 Claims, 11 Drawing Sheets

(b)

(a)

(a)

(b)

IMAGE FORMING APPARATUS

FIELD OF THE INVENTION AND RELATED ART

The present invention relates to an image forming apparatus for forming an image by an electrophotographic method.

In a printer which is an image forming apparatus of the electrophotographic type, the following light exposure type has been known in general. That is, a light exposure type in which a photosensitive drum is exposed to light by using a light exposure head such as a light emitting diode (LED) or an organic electroluminescence (EL) element and a latent image is formed has been known in general. The exposure head includes a light emitting element array arranged in a longitudinal direction of the photosensitive drum and a rod lens array for forming an image on the photosensitive drum with light from the light emitting element array. As regards the LED or the organic EL element, a constitution having a surface (planar) emitting shape such that an irradiation direction of light from a light emitting surface is the same direction as the rod lens array has been known. Here, a length of the light emitting element array is determined depending on a width of an image forming region on the photosensitive drum, and an interval between light emitting elements is determined depending on resolution of the printer. For example, in the case of the printer of 1200 dpi in resolution, a pixel interval is 21.16 μm, and therefore, the interval between the light emitting elements is also an interval corresponding to 21.16 μm. In the printer using such an exposure head, compared with a printer of a laser scanning type in which the photosensitive drum is scanned with a laser beam deflected by a rotatable polygonal mirror, the number of component parts is small, and therefore, downsizing and cost reduction of the printer are easy. Further, in the printer using the exposure head, noise generated by rotation of the rotatable polygonal mirror is reduced.

In the printer using the exposure head, a lens array of a refractive index distribution type is used in an optical lens. The lens array of the refractive index distribution type does not require a concave or convex lens and is capable of changing a focal length by a lens length and there is no need to constitute a complicated optical system, and therefore, a compact optical system can be constituted. On the other hand, the lens array of the refractive index distribution type is short in distance from a light emission point to an image forming surface, and therefore, there is a need to carry out exposure from a position close to the photosensitive drum. For that reason, a problem such that toner remaining on the photosensitive drum surface is liable to deposited on the surface of the rod lens array and thus a defective image (principally a stripe image extending in a paper (sheet) feeding direction) due to toner contamination arose. Therefore, for example, in Japanese Laid-Open Patent Application 2012-144019, in order to perform cleaning for removing the toner contamination of the exposure head, a method of opening a cover of an image forming apparatus main assembly and a structure of drawing out an image forming station from the image forming apparatus main assembly are disclosed.

FIG. 11 is a schematic view for illustrating a positional relationship among a main assembly substrate including a controller for controlling the image forming apparatus, an image forming station including light exposure heads, and a relay substrate of relaying a control signal, outputted from the main assembly substrate, to the respective exposure heads, in a casing (apparatus casing) of the image forming apparatus of a conventional type. Incidentally, the image forming station includes photosensitive drums on which electrostatic latent images are formed by the exposure heads indicated by dotted lines in the figure and is provided with an image forming portion (not shown) for forming images, and is accommodated in a unit capable of being inserted in and drawn out of the image forming apparatus. In FIG. 11, as regards arrow directions, "FR" represents a frontward direction of the image forming apparatus, "RR" represents a rearward direction, "U" represents a top (upward) direction of the image forming apparatus, and "D" represents a bottom (downward) direction. Part (a) of FIG. 11 is a schematic view showing a state in which the unit, in which the image forming station is accommodated, is accommodated inside the image forming apparatus. On the other hand, part (b) of FIG. 11 is a schematic view showing a state in which the unit, in which the image forming station is accommodated, is drawn out of the image forming apparatus in order to perform cleaning for removing the toner contamination of the exposure head. The relay substrate carries out serial-parallel conversion of the received control signal in order to send, to the respective exposure heads, the control signal sent from the main assembly substrate through high-speed serial communication, and then sends the converted control signal to the respective exposure heads via a plurality of communication lines connected to the exposure heads. For that reason, the relay substrate may desirably be disposed close to the exposure heads.

However, as shown in part (b) of FIG. 11, the relay substrate is disposed on a drawing-out side surface (on a front side of the drawing sheet of FIG. 11 as seen from the front surface of the main assembly) of the unit in which the image forming station is accommodated. For that reason, when an entirety of the unit in which the image forming station is accommodated is drawn out to an outside of the image forming apparatus, the relay substrate is exposed to the outside, so that there is a liability that an operator erroneously touches the relay substrate and the relay substrate is broken.

SUMMARY OF THE INVENTION

According to an aspect of the present invention, there is provided an image forming apparatus comprising a main assembly provided with an opening; and a drawer unit capable of being mounted in and drawn out of the main assembly through the opening, wherein the drawer unit comprises a rotatable photosensitive drum, an optical print head including a light emitting element configured to emit light to which the photosensitive drum is exposed, a relay substrate connected to the optical print head with a cable to relay and transmit a driving signal for driving the optical print head from a main assembly substrate provided in the main assembly to the optical print head, a first wall portion configured to support one end side of the optical print head with respect to a rotational axis direction of the photosensitive drum, a second wall portion configured to support the other end side of the optical print head with respect to the rotational axis direction, and a third wall portion continuously formed between an upstream end portion of the first wall portion and an upstream end portion of the second wall portion with respect to a drawing-out direction of the drawer unit from the main assembly and forming a part of an outer wall of the drawer unit in cooperation with the first wall portion and the second wall portion, wherein the relay substrate is provided on a surface of the third wall portion on an upstream side with respect to the drawing-out direction.

Further features of the present invention will become apparent from the following description of exemplary embodiments with reference to the attached drawings.

BRIEF DESCRIPTION OF THE DRAWINGS

Parts (a) to (c) of FIG. 1 are schematic sectional views each showing a structure of an image forming apparatus of embodiments 1 to 3.

Part (a) of FIG. 2 is a perspective view for illustrating a positional relationship between a light exposure head and a photosensitive drum in the embodiments 1 to 3, and part (b) of FIG. 2 is a schematic view for illustrating a structure of the exposure head in the embodiments 1 to 3.

Figure 3:
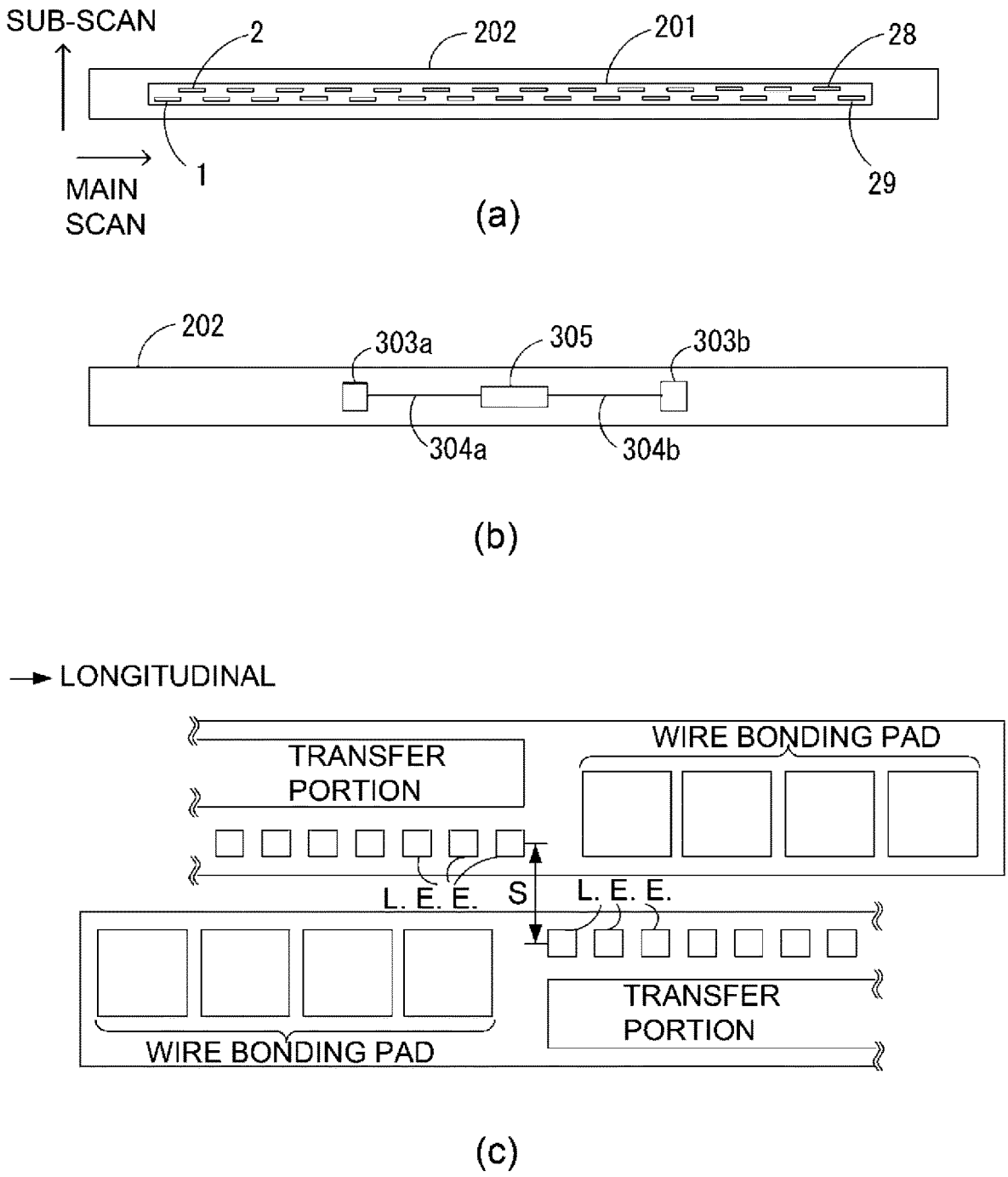

Parts (a) and (b) of FIG. 3 are schematic views each showing a driving substrate in the embodiments 1 to 3, and part (c) of FIG. 3 is a schematic view for illustrating a structure of surface emitting element array chips in the embodiments 1 to 3.

Figure 4:
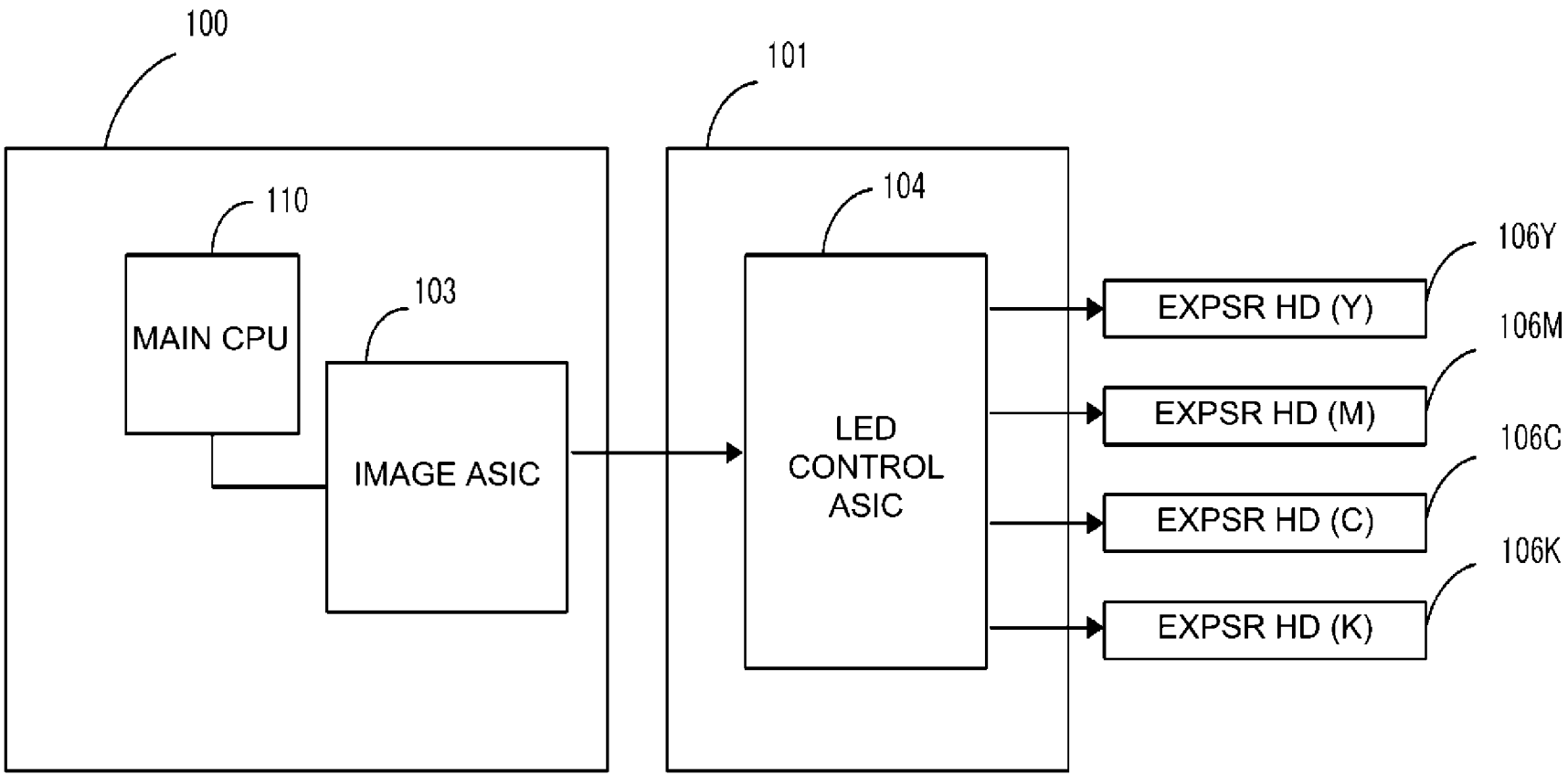

FIG. 4 is a control block diagram of a control substrate and a relay substrate in the embodiments 1 and 2.

Figure 5:
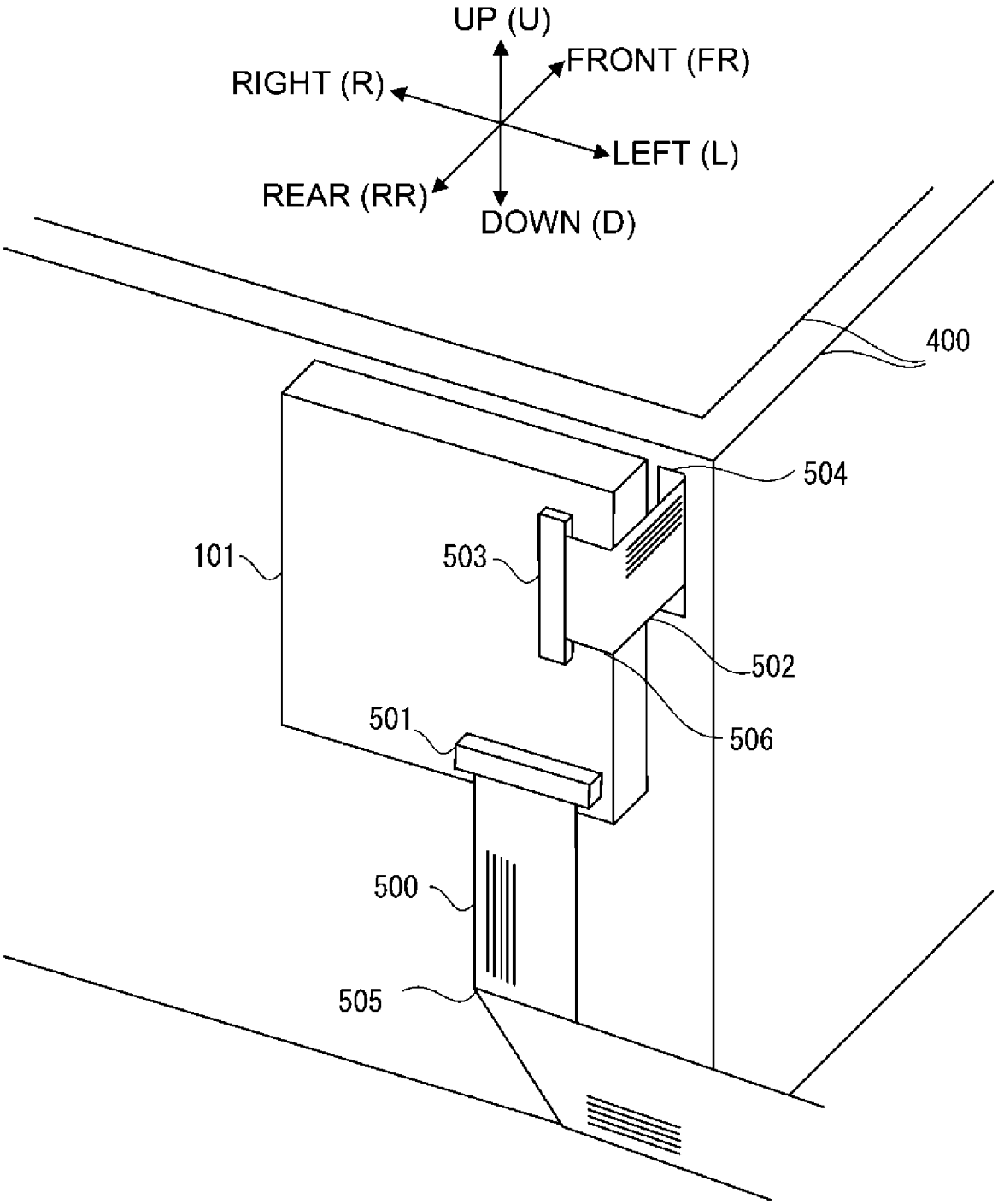

FIG. 5 is a perspective view for illustrating an arrangement of the relay substrate in the embodiments 1 to 3.

Figure 6:
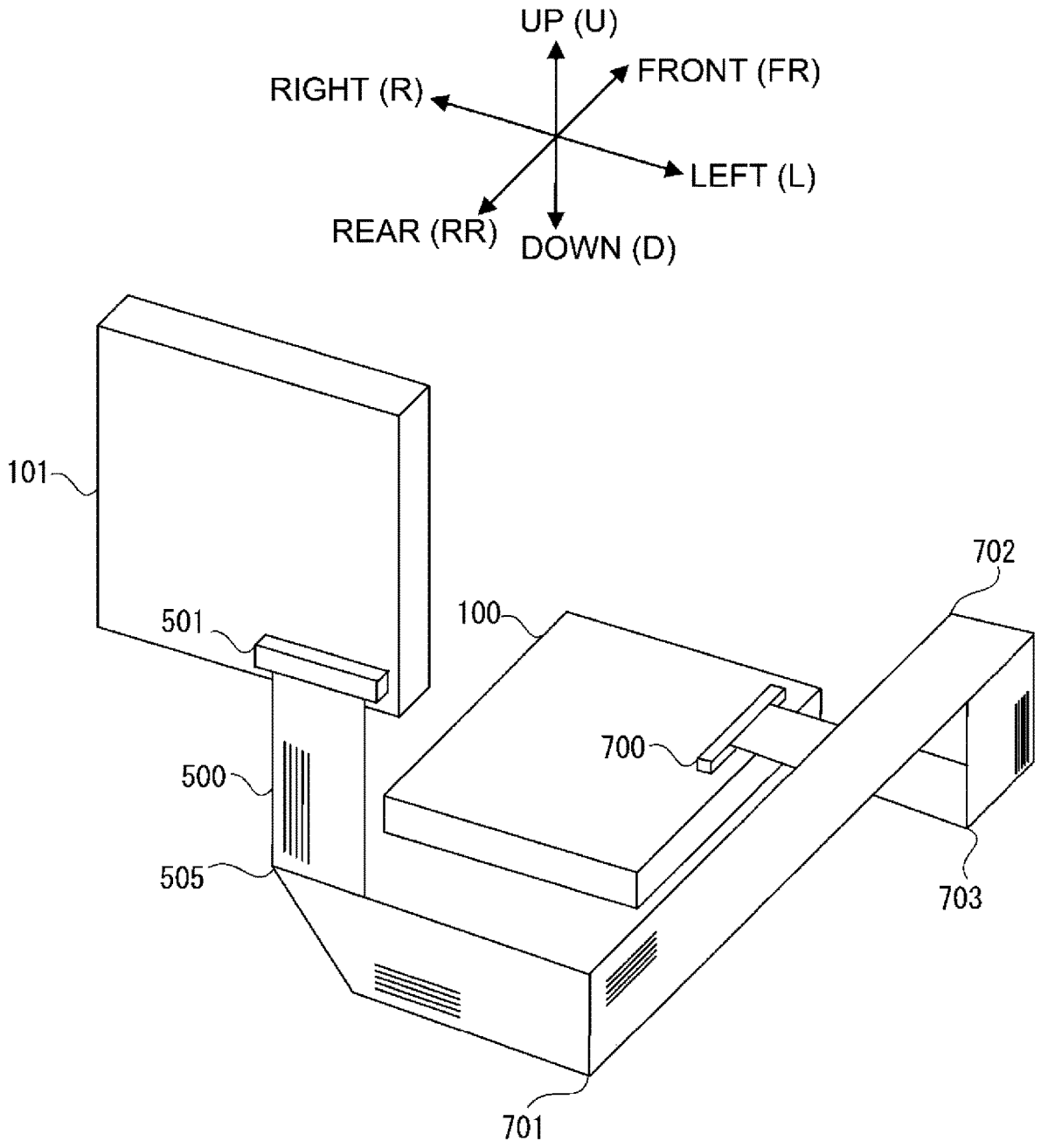

FIG. 6 is a perspective view for illustrating connection between the control substrate and the relay substrate in embodiment 1.

Figure 7:
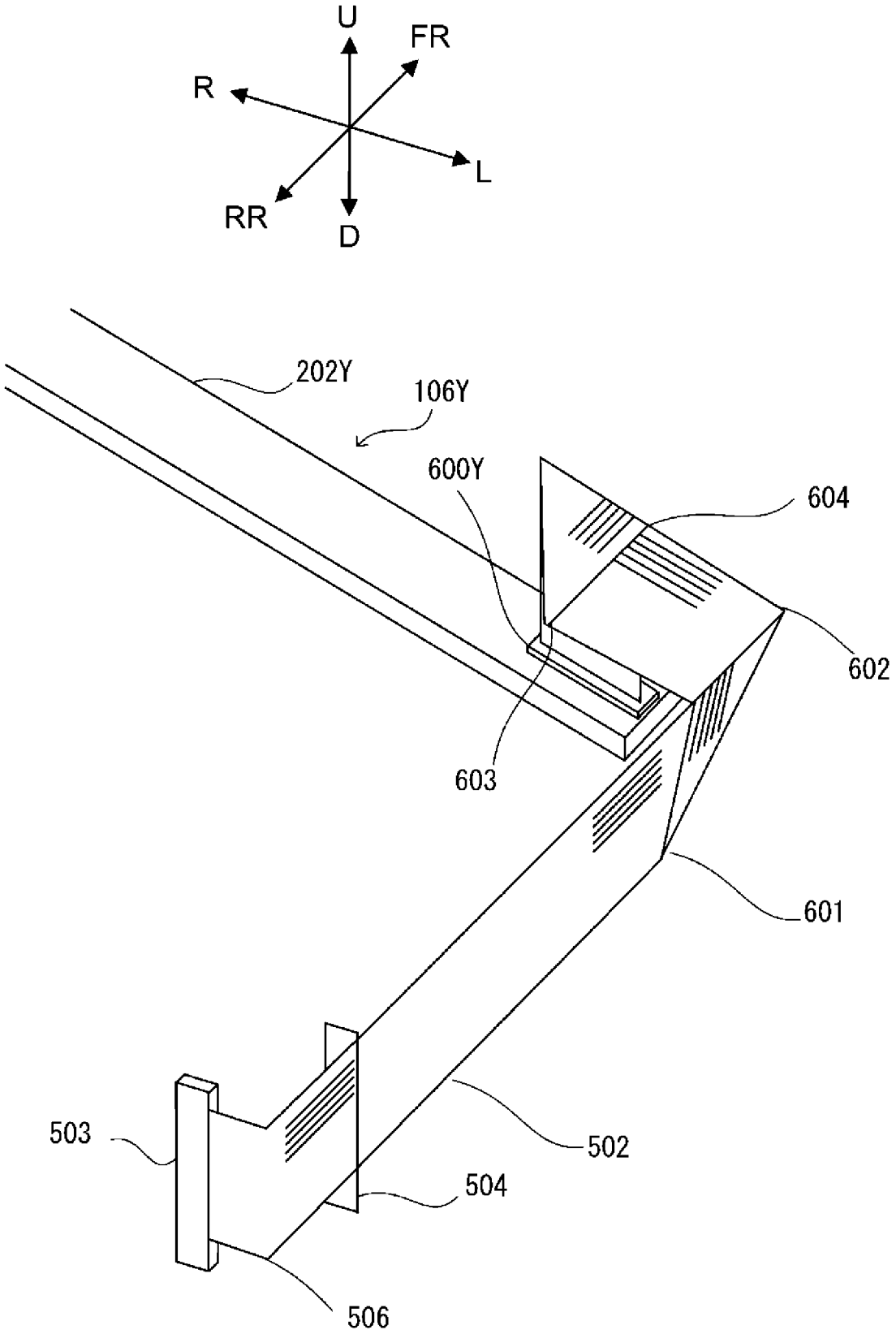

FIG. 7 is a perspective view for illustrating connection between a light exposure head and the relay substrate in the embodiments 1 to 3.

Figure 8:
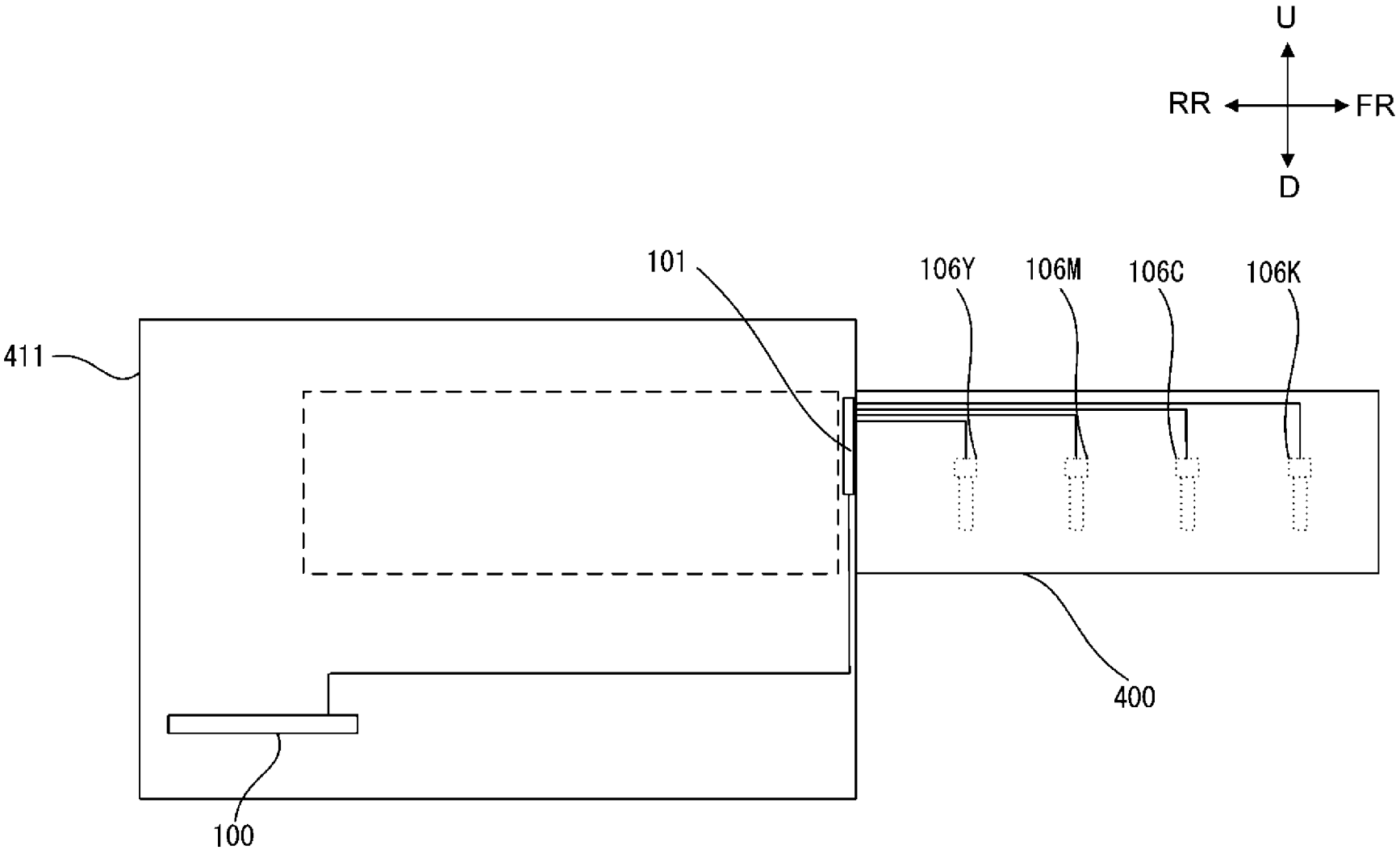

FIG. 8 is a schematic view for illustrating cable connection of the control substrate and light exposure heads with the relay substrate in the embodiments 1 to 3.

Figure 9:
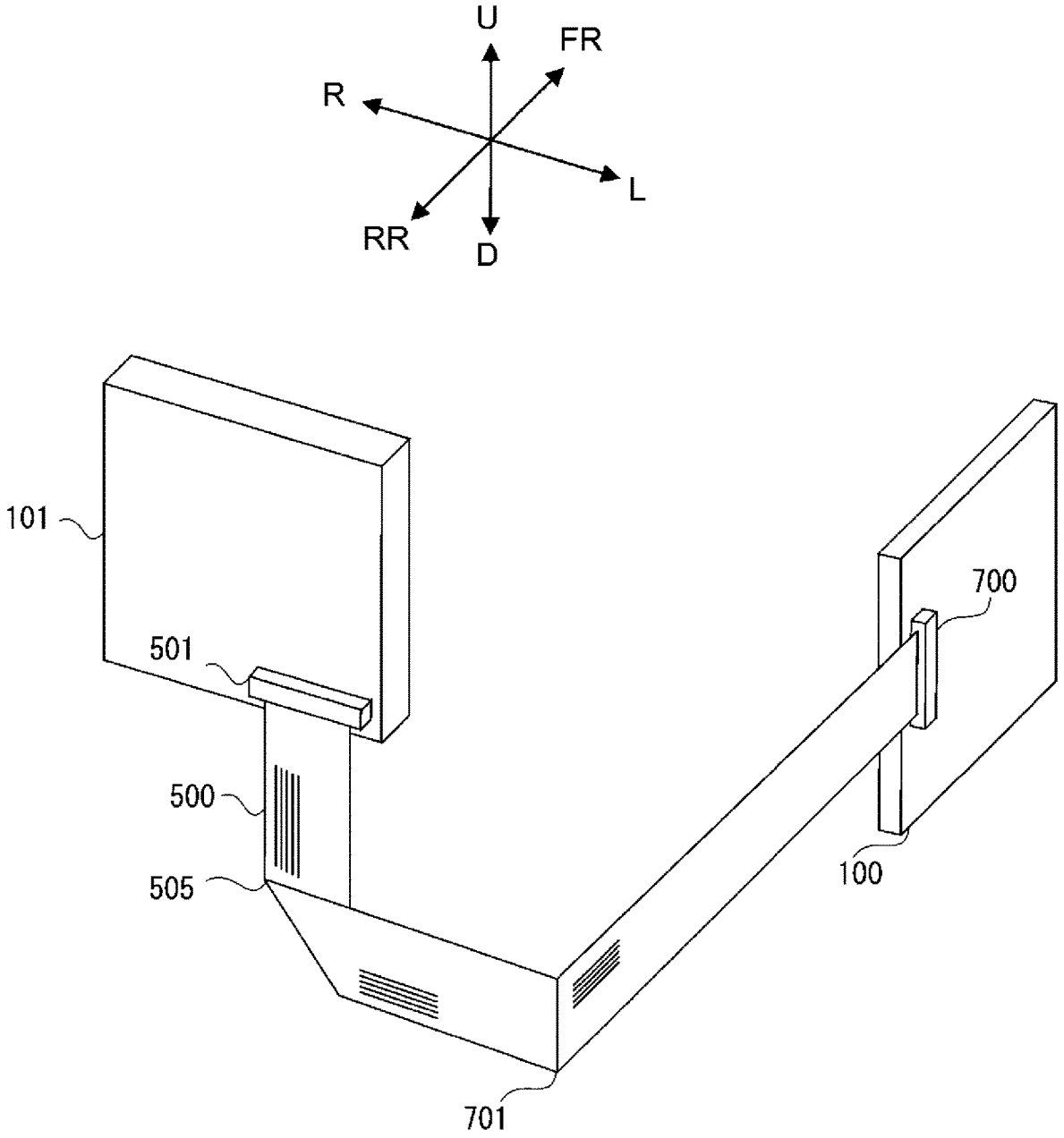

FIG. 9 is a perspective view for illustrating connection between the control substrate and the relay substrate in embodiment 2.

Figure 10:
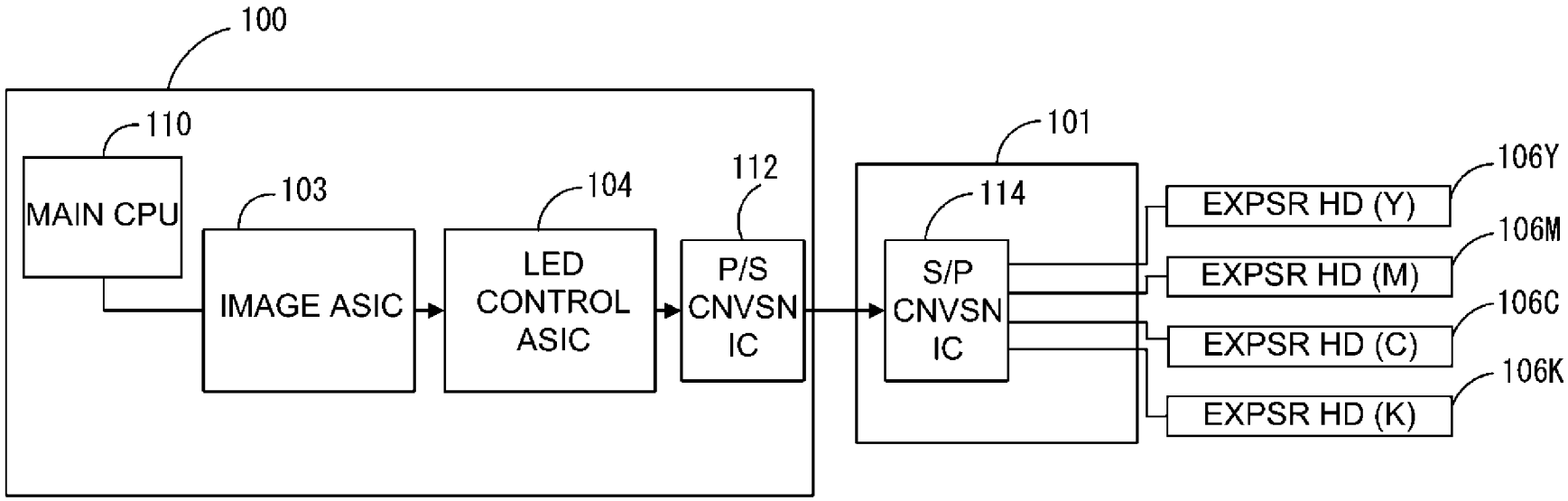

FIG. 10 is a control block diagram of the control substrate and the relay substrate in the embodiment 3.

Figure 11:
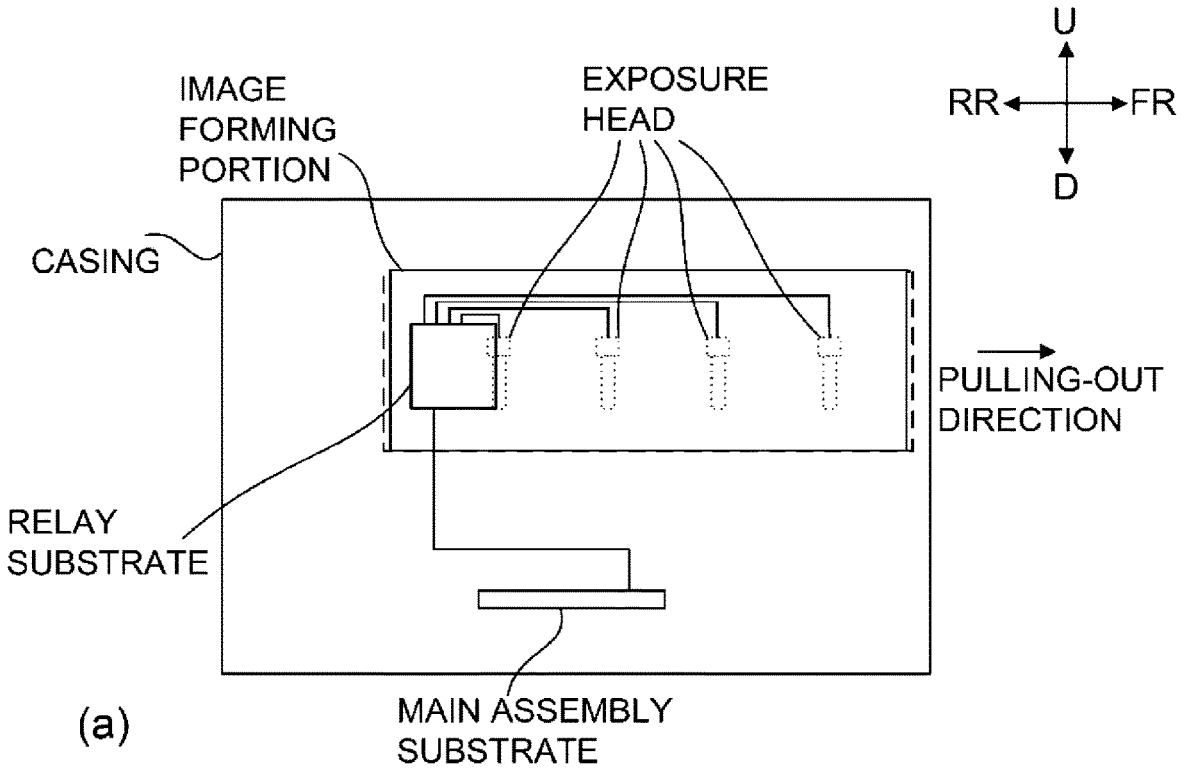
Figure 11:
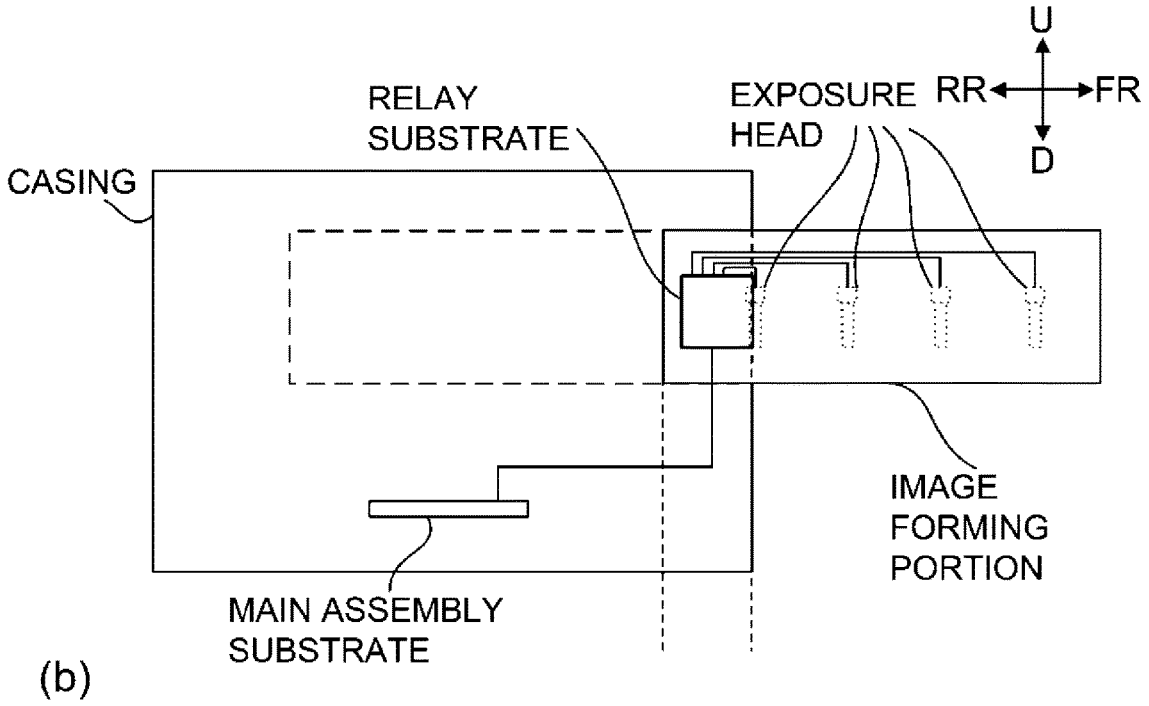

Parts (a) and (b) of FIG. 11 are schematic views each showing an arrangement of a relay substrate in a conventional example.

DESCRIPTION OF EMBODIMENTS

In the following, embodiments of the present invention will be specifically described with reference to the drawings.

Embodiment 1

[Structure of Image Forming Apparatus]

Figure 1:
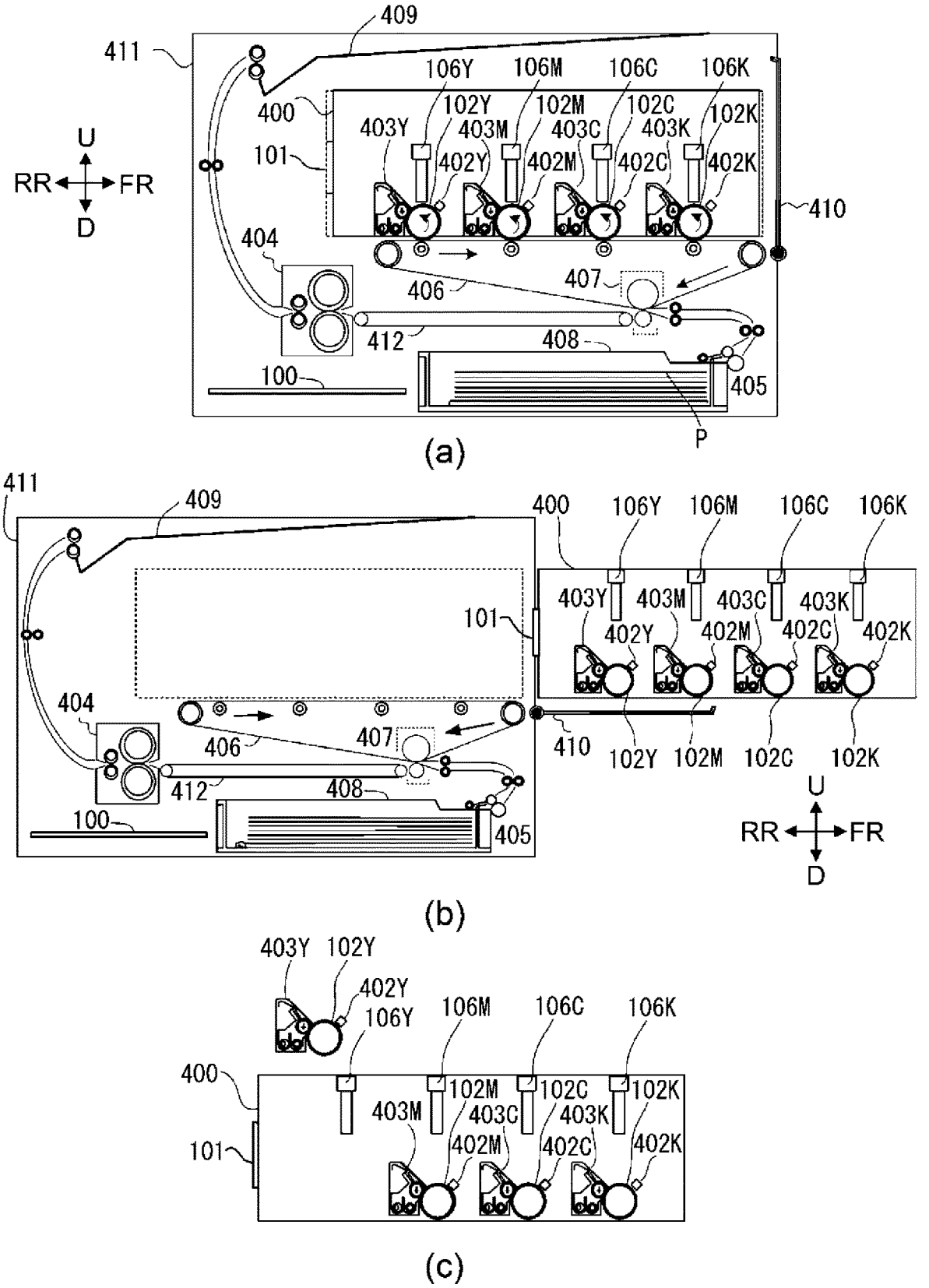

Part (a) of FIG. 1 is a schematic sectional view showing a structure of an image forming apparatus of an electrophotographic type in embodiment 1. The image forming apparatus shown in part (a) of FIG. 1 includes a casing 411 (an example of an apparatus main assembly), an image forming station 400 (an example of a drawer unit), a fixing portion 404, a sheet (paper) feeding/conveying portion 405, a door 410 for opening and closing a drawing-out opening of the image forming station 400, and a control substrate 100 (main assembly substrate) including a controller (not shown) for controlling image formation. Part (a) of FIG. 1 is the sectional view showing a state in which the image forming station 400 is mounted in the image forming apparatus. Incidentally, in parts (a) and (b) of FIG. 1, "FR" (right side of the drawing sheet) is a frontward direction of the image forming apparatus, and "RR" (left side of the drawing sheet) is a rearward direction of the image forming apparatus. Further, "U" (upper side of the drawing sheet) is a top (upward) direction of the image forming apparatus, and "D" (lower side of the drawing sheet) is a bottom (downward) direction of the image forming apparatus.

The image forming station 400, which is an example of the drawer unit, is a unit which includes therein four process cartridges (image forming portions) of different toner colors of yellow (Y), magenta (M), cyan (C) and black (K) and which is capable of being mounted in and drawn out of the image forming apparatus. The image forming station 400 includes an open surface which is open upward and an outer periphery thereof is surrounded by side walls. Further, on a back side of a side wall portion (third wall portion) which is an upstream side with respect to a direction in which the image forming station 400 is drawn out, a relay substrate 101 for relaying a control signal from the control substrate 100 to light exposure heads 106 (described later) is provided. The relay substrate 101 converts image data (an example of a driving signal), outputted from the control substrate 100, into irradiation data and outputs the irradiation data to the respective exposure heads 106. The respective process cartridges have the same constitution, and each process cartridge is constituted by a photosensitive drum 102 rotatable relative to an image forming apparatus main assembly, a charging device 402 and a developing device 403. Further, the exposure head 106 is provided opposed to the photosensitive drum 102 of each process cartridge. One end side of the exposure head 106 with respect to a rotational axis direction of the photosensitive drum 102 is supported by a side wall portion (first wall portion) of the image forming station 400. Further, the other side of the exposure head 106 with respect to the rotational axis direction of the photosensitive drum 102 is supported by a side wall portion (second wall portion) of the image forming station 400. Further, the respective process cartridges are also supported by the two side wall portions supporting the exposure heads 106 and are capable of being accommodated between the two side wall portions. That is, the image forming station 400 includes a first wall portion, a second wall portion and a third wall portion, which is a side wall connecting an upstream side end portion of the first wall portion with respect to a drawing-out direction and an upstream side end portion of the second wall portion with respect to the drawing-out direction. The third wall portion forms an outer wall of the image forming station 400 in cooperation with the first wall portion and the second wall portion. Incidentally, the first wall portion, the second wall portion and the third wall portion are constituted by separate members, and may also be fixed to each other with screws or the like.

Incidentally, suffixes Y, M, C and K of reference numerals represent members of the process cartridges for yellow, magenta, cyan and black, respectively. In the following, description of the suffixes will be omitted except for the case where description of a specific process cartridge is made.

When image formation is started, in each of the process cartridges, the charging device 402 electrically charges uniformly a surface of the photosensitive drum 102 rotating in an arrow direction (counterclockwise direction) in the figure. Then, the exposure head 106, which is an optical print head, causes a chip surface of an LED array to emit light depending on the irradiation data from the relay substrate 101, and the emitted light is condensed at the surface of the photosensitive drum 102 by a rod lens array, so that an electrostatic latent image is formed. The developing device 403 deposits the toner on the electrostatic latent image formed on the photosensitive drum 102, and thus develops the electrostatic latent image with the toner, so that a toner image is formed.

A transfer belt 406 is an endless belt which is provided between a sheet (paper) feeding cassette 408 and the respective photosensitive drums 102 and which is rotatable in an arrow direction (clockwise direction) in the figure while being stretched by a plurality of rollers. Further, at positions opposing the photosensitive drums 102, transfer rollers are provided inside the transfer belt 406 so as to sandwich the transfer belt 406 between the transfer rollers and the photosensitive drums 102. The toner images formed on the photosensitive drums 102 of the process cartridges are transferred onto the transfer belt 406 contacted to the photosensitive drums 102 by the transfer rollers, whereby the respective color toner images are superposed on the transfer belt 406, so that a full-color toner image is formed.

On the other hand, in synchronism with the image formation of the respective process cartridges of the image forming station 400, a recording medium (material) P is fed from the sheet feeding cassette 408 of the sheet feeding/conveying portion 405 and is conveyed toward a secondary transfer device 407. In the secondary transfer device 407, the toner images on the transfer belt 406 are transferred onto the fed recording material P. Then, the recording material P on which the toner images are transferred is conveyed to a fixing portion 404 by a conveying belt 412. In the fixing portion 404, the toner images on the conveyed recording material P are pressed and heated, so that the toner images are fixed on the recording material P. Thereafter, the recording material P is conveyed in a conveying passage and is discharged onto a discharge tray 409.

Part (b) of FIG. 1 is a sectional view showing a state in which the image forming station 400 which is the example of the drawer unit is drawn out of the image forming apparatus. Thus, the image forming apparatus in this embodiment includes an apparatus main assembly (a casing 411 (described later)) and the image forming station 400, which is capable of being mounted in and drawn out of the apparatus main assembly. That is, the casing 411 referred to herein refers to a portion, of the image forming apparatus, other than the image forming station 400. Part (b) of FIG. 1 shows a state in which the image forming station 400 is drawn out of the casing 411 through an opening to an outside of the image forming apparatus. The opening appears by movement of the door 410, provided rotatably as shown in part (a) of FIG. 1, from a closed state to an open state. When the door 410 is in the closed state, the opening is covered with the door 410. On the other hand, when the door 410 is in the open state, the opening is open, so that through this opening, an operation for mounting the image forming station 400 in the apparatus main assembly and for drawing out the image forming station 400 from the apparatus main assembly can be performed. Part (b) of FIG. 1 shows a state in which the image forming station 400 is drawn out to the outside of the image forming apparatus through the drawing-out opening which is the opening formed by the opening operation. In the image forming apparatus of this embodiment, rail members (not shown) on which the image forming station 400 is mounted are provided along a mounting direction of the image forming station 400 in order to facilitate a mounting and drawing out operation of the image forming station 400. The image forming station 400 is mounted on the rail members and is guided by the rail members, so that the image forming station 400 is movable inside the image forming apparatus. Further, when the opening operation of the door 410 is performed, by an unshown mechanism, the photosensitive drums 102 of the respective process cartridges are spaced from the transfer belt 406. Similarly, the exposure heads 106 are also moved in an upward direction (top surface direction) by an unshown mechanism, and are spaced from the photosensitive drums 102 of the process cartridges. On the other hand, when the closing operation of the door 410 is performed, the exposure heads 106 are moved in a downward direction (bottom direction) by the unshown mechanism to positions where the surfaces of the photosensitive drums 102 of the respective process cartridges are exposed to light by the exposure heads 106.

Part (c) of FIG. 1 is a sectional view showing a state in which the process cartridge for yellow (Y) is dismounted from the image forming station 400. The process cartridge in this embodiment is prepared by integrally assembling the photosensitive drum 102, the charging device 402 and the developing device 403 into a unit, and has a constitution in which the process cartridge is easily dismounted from the image forming station 400 and can be exchanged with new one.

[Structure of Light Exposure Head]

Figure 2:
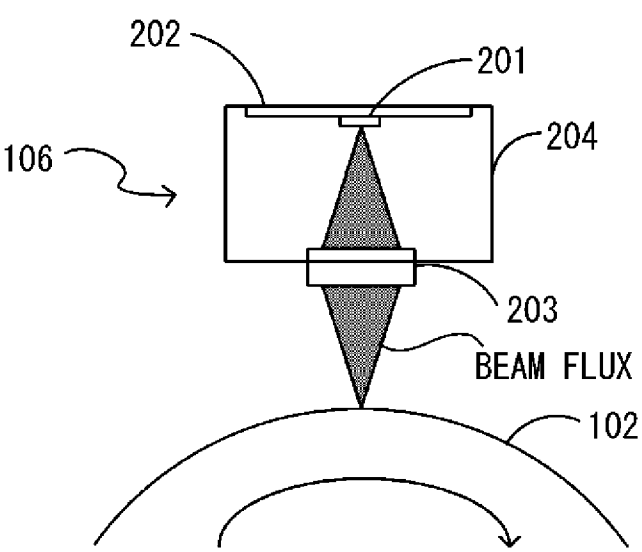
Figure 2:
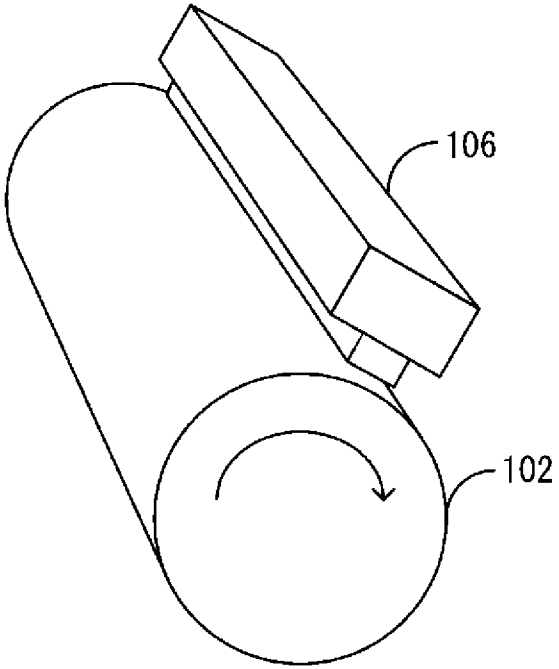

Next, the exposure head 106 for performing the exposure of the photosensitive drum 102 to light will be described using FIG. 2. Part (a) of FIG. 2 is a perspective view showing a positional relationship between the exposure head 106 and the photosensitive drum 102, and part (b) of FIG. 2 is a schematic view for illustrating an internal structure of the exposure head 106 and a state in which a beam flux from the exposure head 106 is concentrated at the photosensitive drum 102 by a rod lens array 203. As shown in part (a) of FIG. 2, the exposure head 106 is mounted in the image forming apparatus (FIG. 1) by a mounting member (not shown) at a position which is above the photosensitive drum 102 rotating in an arrow direction and where the exposure head 106 opposes the photosensitive drum 102.

As shown in part (b) of FIG. 2, the exposure head 106 is constituted by a driving substrate 202, a surface emitting element array element group 201 mounted on the driving substrate 202, the rod lens array 203 and a housing 204. To the housing 204, the rod lens array 203 and the driving substrate 202 are mounted. The rod lens array 203 concentrates a beam flux (light flux), emitted from the surface emitting element array element group 201, onto the photosensitive drum 102. In a factory, an assembling adjustment operation of the exposure head 106 alone is performed, so that focus adjustment and light intensity adjustment of each of spots are carried out. Here, the assembling adjustment is carried out so that a distance between the photosensitive drum 102 and the rod lens array 203 and a distance between the rod lens array 203 and the surface emitting element array element group 201 are predetermined intervals (distances). As a result, the light from the surface emitting element array element group 201 is formed on the photosensitive drum 102. For that reason, during focus adjustment in the factory, a mounting position of the rod lens array 203 is performed so that the distance between the rod lens array 203 and the surface emitting element array element group 201 is a predetermined value. Further, during light intensity adjustment in the factory light emitting elements of the surface emitting element array element group 201 are successively caused to emit light, and adjustment of a driving current of each of the light emitting elements is carried out so that the light concentrated at the surface of the photosensitive drum 102 via the rod lens array 203 has a predetermined light intensity.

[Structure of Surface Emitting Element Array Element Group]

FIG. 3 is a schematic view for illustrating the surface emitting element array element group 201. Part (a) of FIG. 3 is a schematic view showing a structure of a surface (first surface) of the driving substrate 202 on which the surface emitting element array element group 201 is mounted, and part (b) of FIG. 3 is a schematic view showing a structure of a surface (second surface) of the driving substrate 202 opposite from the first surface on which the surface emitting element array element group 201 is mounted.

As shown in part (a) of FIG. 3, the surface emitting element array element group 201 has a constitution in which 29 surface emitting element array chips 1 to 29 are arranged in two rows in a staggered shape along a longitudinal direction of the driving substrate 202. Incidentally, in part (a) of FIG. 3, an up down direction shows a sub scan direction (rotational direction of the photosensitive drum 102) which is a first direction, and a horizontal direction shows a main scan direction which is a second direction perpendicular to the sub scan direction. Each of elements of the surface emitting element array element group 201 having 516 light emitting points in total is arranged with a predetermined resolution pitch in a longitudinal direction of the surface emitting element array chips. In this embodiment, the pitch of each element of the surface emitting element array chips is about 21.16 μm (≈2.54 cm/1200 dots), which is a pitch of a resolution of 1200 dpi which is a first resolution. As a result, an end to end interval of the 516 light emitting points in one (single) surface emitting element array chip is about 10.9 mm (≈21.16 μm×516). The surface emitting element array element group 201 is constituted by 29 surface emitting element array chips. The number of light emitting elements, of the surface emitting element array element group 201, capable of exposing the photosensitive drum to light is 14,964 elements (=516 elements×29 chips), so that image formation corresponding to an image width of about 316 mm (≈10.9 mm×29 chips) with respect to the main scan direction is possible.

Part (c) of FIG. 3 is a schematic view showing a state of a boundary between chips of the surface emitting element array chips disposed in the two rows along the longitudinal direction, and the horizontal direction is the longitudinal direction of the surface emitting element array element group 201 of part (a) of FIG. 3. As shown in part (a) of FIG. 3, at an end portion of the surface emitting element array chips, wire bonding pads to which a control signal is inputted are provided, and by a signal inputted from the wire bonding pads, a transfer portion and the light emitting elements are driven. Further, the surface emitting element array chips include a plurality of light emitting elements. Even at a boundary between the surface emitting element array chips, a pitch (an interval between center points of two light emitting elements) of the light emitting elements with respect to the longitudinal direction is about 21.16 μm which is a pitch of the resolution of 1200 dpi. Further, the surface emitting element array chips arranged in upper and lower (two) rows are disposed so that an interval between light emitting points of the upper and lower surface emitting element array chips (indicated by double-pointed arrow S) is about 84 μm (a distance which is an integral multiple of each resolution corresponding to 4 pixels in 1200 dpi, i.e., 8 pixels in 2400 dpi).

Further, as shown in part (b) of FIG. 3, on the surface of the driving substrate 202 opposite from the surface on which the surface emitting element array element group 201 is mounted, driving portions 303*a* and 303*b* and a connector 305 are mounted. The driving portions 303*a* and 303*b* disposed on both sides of the connector 305 drive the surface emitting element array chips 1 to 15 and the surface emitting element array chips 16 to 29, respectively. The driving portions 303*a* and 303*b* are connected to the connector 305 via patterns 304*a* and 304*b*, respectively. To the connector 305, signal lines (described later) from the relay substrate 101 (FIGS. 5 and 6), for controlling the driving portions 303*a* and 303*b*, and a power source voltage and the ground are connected, and they are connected to the driving portions 303*a* and 303*b* through the connector 305. Further, from each of the driving portions 303*a* and 303*b*, wiring for driving the surface emitting element array element group 201 passes through an inner layer of the driving substrate 202 and is connected to the surface emitting element array chips 1 to 15 and the surface emitting element array chips 16 to 29. Incidentally, in this embodiment, each of the light emitting elements is a light emitting diode (LED), but, for example, may also be an organic light emitting diode (OLED).

[Control Constitution of Control Substrate, Relay Substrate and Light Exposure Head]

FIG. 4 is a block diagram for illustrating a control constitution of the control substrate 100, the relay substrate 101 and the respective exposure heads 106 (106Y, 106M, 106C, 106K). The control substrate 100 is, as shown in FIG. 1, disposed at a lower portion of the casing 411 of the image forming apparatus 100, and includes a main CPU 110 for controlling the image formation and an image ASIC (application-specific integrated circuit: an example of a control circuit) 103. When the image ASIC 103 receives an image formation instruction from the main CPU 110, the image ASIC 103 outputs image data to the relay substrate 101. In the image data, pixel data corresponding to each of the surface light emitting elements of the surface emitting element array chips 1 to 29 mounted on each of the exposure heads 106 are included. Then, the image ASIC 103 outputs the image data to the relay substrate 101 in a predetermined order. Incidentally, on the control substrate 100, various control circuits for controlling the image formation are provided, but in this embodiment, only the control circuit relating to the control of the exposure heads 106 is described, and other control circuits will be omitted from description.

The relay substrate 101 is, as shown in FIG. 1, provided on a surface of the rear side wall (third wall portion) of the image forming station 400, opposite from the opening-side surface. In other words, the relay substrate 101 is provided on an upstream side wall of the image forming station 400 with respect to the drawing-out direction of the image forming station 400 relative to the image forming apparatus main assembly. Here, as in understood from FIG. 1, in the state in which the image forming station 400 is accommodated in the casing 411, the fixing device 404 is disposed below the relay substrate 101 with respect to a vertical direction. For that reason, there is a possibility that the relay substrate 101 is increased in temperature by heat generated by the fixing portion 404. Therefore, in order to suppress the temperature rise of the relay substrate 101, a method in which the relay substrate 101 is, for example, covered with a cover made of metal is employed in some instances. This cover may also be partly provided with an opening, and may also be made of resin material without being limited to the metal.

Further, the relay substrate 101 includes an LED control ASIC 104. The LED control ASIC 104 is connected to the exposure heads 106Y, 106M, 106C and 106K corresponding to the respective process cartridges via flexible flat cables 502, for transmitting signals (described later).

The LED control ASIC 104 receives the image data outputted from the image ASIC 103 of the control substrate 100, and on the basis of the received image data, generates irradiation data corresponding to the respective surface light emitting elements of the surface emitting element array chips 1 to 29 mounted on the exposure heads 106. The image data from the image ASIC 103 includes color information on whether or not the image data is for a color of yellow (Y), magenta (M), cyan (C) and black (K). On the basis of the color information, the LED control ASIC 104 outputs the irradiation data corresponding to the respective colors to the driving substrates 202 of the exposure heads 106 on which the surface emitting element array chips for the respective colors are mounted. The driving portions 303*a* and 303*b* mounted on each of the driving substrates 202 of the exposure heads 106 carry out turning on control of the surface light emitting elements on the basis of the irradiation data received from the LED control ASIC 104.

[Connection Constitution Between Relay Substrate and Control Substrate]

FIG. 5 is a perspective view for illustrating a connection constitution of the relay substrate 101 provided for the image forming station 400. In FIG. 5, "FR" represents a frontward direction of the image forming apparatus, "RR" represents a rearward direction of the image forming apparatus, "U" represents a top surface (upward) direction of the image forming apparatus, and "D" represents a bottom (downward) direction of the image forming apparatus. These are also true for FIGS. 6 to 9 and 11 (described later). Further, "L" represents a leftward direction of the image forming apparatus as seen in the frontward direction, and "R" represents a rightward direction of the image forming apparatus as seen in the frontward direction. Incidentally, these are also true for FIGS. 6 to 9 and 11 (described later).

As shown in FIG. 5, the relay substrate 101 is disposed on the side wall of the image forming station 400 on the rear surface side, and includes two flat cable connectors 501 and 503. The connector 503 is disposed above the connector 501 with respect to the vertical direction. A flat cable 500 connected to the flat cable connector 501 extends from the flat cable connector 501 in the "D" direction in the figure and thereafter is folded back at a fold back point 505, and extends in the "L" direction in the figure and is connected to the control substrate 100 (described specifically later). On the other hand, the flat cable 502 connected to the flat cable connector 503 extends from the flat cable connector 503 in the "L" direction in the figure and thereafter is folded back at a fold back point 506 in the "FR" direction. The flat cable 502 folded back in the "FR" direction passes through a through hole 504 provided in the image forming station 400, extends along an "L" side wall of the image forming station 400, and is connected to the driving substrate 202 of the exposure head 106 (described specifically later). Thus, the flat cable 502 is disposed through the through hole 504 formed in the third wall portion, so that the following effects can be achieved. That is, when the image forming station 400 is mounted in and drawn out of the casing 411, the flat cable 502 can be prevented from being sandwiched and broken between the image forming station 400 and the casing 411. In addition, with respect to a rotational axis direction of the photosensitive drum 102, the flat cable 502 is not disposed significantly beyond the image forming station 400, so that a size of the image forming apparatus with respect to the rotational axis direction of the photosensitive drum 102 can be downsized. Here, as is understood from parts (a) and (b) of FIG. 1, on a rear side of the image forming station 400, that is, on a back side of the third wall portion, a dead space is formed. For that reason, even when the relay substrate 101 is disposed on the back side of the third wall portion, the size of the image forming apparatus with respect to the front back (rear) direction is not upsized. Incidentally, in this embodiment, as regards the flat cable connector 503, a connector of the flat cable 502 connected to the driving substrate 202 of the exposure head 106Y is shown.

FIG. 6 is a schematic view for illustrating a connection state of the flat cable 500 connecting the relay substrate 101 and the control substrate 100. Incidentally, FIG. 6 is the schematic view for illustrating a connection relationship between the relay substrate 101 and the control substrate 100, and other devices provided in the image forming apparatus are omitted from illustration. The flat cable 500 extends from the flat cable connector 501 in the "D" direction in the figure, and thereafter is folded back at a fold back point 505, and extends in the "L" direction in the figure. The flat cable 500 extends to the left side wall in the casing 411 (not shown in FIG. 6) of the image forming apparatus, and is folded back at a fold back point 701 in the "FR" direction in the figure. The flat cable 500 folded back in the "FR" direction is further folded back in the "D" direction in the figure at a fold back point 702 positioned just beside the flat cable connector 700, with respect to the "L" direction, mounted on the control substrate 100. Then, the flat cable 500 folded back in the "D" direction is folded back in the "R" direction at a fold back point 703 having the same height (level) as the flat cable connector 700 with respect to the "L" and "R" directions in the figure, and thereafter is connected to the flat cable connector 700.

[Connection Constitution with Driving Substrate, Relay Substrate and Light Exposure Head]

FIG. 7 is a schematic view for illustrating a connection state of the flat cable 502 for connecting the relay substrate 101 and the exposure head 106Y. Incidentally, in this embodiment, a connection constitution between the relay substrate 101 and the exposure head 106Y is illustrated as a representative example. A described above, the flat cable connector 503 shown in FIG. 5 is illustrated as a connector for the flat cable 502 connected to the exposure head 106Y. A connection constitution to the exposure heads 106M, 106C and 106K is similar in fold-back manner as the case of the exposure head 106Y, and therefore will be omitted from description. Further, on the relay substrate 101, flat cable connectors of flat cables connected to the exposure heads 106M, 106C and 106K are also provided similarly, but are omitted from illustration in FIGS. 5 and 7.

In FIG. 7, the flat cable 502 extends from the flat cable connector 503 in the "L" direction, and thereafter, is folded back in the "FR" direction in the figure at a fold-back point 506. The flat cable 502 folded back in the "FR" direction passes through a through hole 504 of the image forming station 400 (not shown) and extends along the "left" side wall (not shown) of the image forming station 400. Then, the flat cable 502 is folded back in the "U" direction in the figure at a fold-back point 601 and is folded back in the "R" direction in the figure at a fold-back point 602, and thereafter is folded back in the "FR" direction at a fold-back point 603 at an "upper" portion of the exposure head 106Y in the figure. Thereafter, the flat cable 502 is further folded back at a fold-back point 603 and extends in the "D" direction in the figure, and thereafter, is connected to a flat cable connector 600 (600Y) mounted on the driving substrate 202 (202Y) of the exposure head 106Y. Incidentally, the exposure head 106Y shown in FIG. 7 shows a state in which the exposure head 106Y is disposed at a position where the photosensitive drum 102Y of the process cartridge for the yellow (Y) is exposed to light by the exposure head 106Y. The flat cable connector 600 corresponds to the connector 305 of part (b) of FIG. 3 and is provided in the neighborhood of a longitudinal end portion of the driving substrate 202. Incidentally, in part (b) of FIG. 3, the position where the connector 305 is provided is a central portion of the driving substrate 202 for convenience of explanation.

As mentioned above, the connection constitution of the flat cables with the control substrate 100, the relay substrate 101 and the respective exposure heads 106 was described. Incidentally, the relay substrate 101 is capable of being disposed at a free position of the rear side wall portion of the image forming station 400, but there is a need to consider the flat cable connector 600 of the exposure head 106 which is a connection destination of the flat cable 502 and to consider the position where the control substrate 100 is disposed. Particularly, as regards connection to the exposure heads 106, there is a need to connect the flat cable connectors 600Y, 600M, 600C and 600K of the exposure heads 106Y, 106M, 106C and 106K to the relay substrate 101 by multipole flat cables, respectively. For that reason, the relay substrate 101 may desirably be disposed on a side close to positions where the flat cable connectors 600 provided on the exposure heads 106 are provided. In this embodiment, as shown in FIG. 7, a constitution in which the flat cable connector 600 is disposed on the "left" side in the figure with respect to the longitudinal direction of the exposure head 106Y and in which the flat cable 502 is connected from the "U" direction of the image forming apparatus in the figure is employed. For that reason, as shown in FIG. 5, an arrangement position of the relay substrate 101 at the rear side wall of the image forming station 400 is the "upper" position on the "left" side of the rear side wall of the image forming station 300 in the figure, so that a cable length of the flat cable 502 is shortest.

Incidentally, in the case where the flat cable connector 600 is disposed on the "right" side in FIG. 7 with respect to the longitudinal direction of the exposure head 106, as seen in the "FR" direction of the image forming station 400, the relay substrate 101 is disposed at an "upper" portion on the "right" side of the rear side wall of the image forming station 400 in the figure. Further, in this case, the through hole 504 of the image forming station 400 is provided on the "right" side of the rear side wall of the image forming station 400 as seen in the "FR" direction of the relay substrate 101 on the image forming station 400 in the figure. Further, in this embodiment, a constitution in which the flat cable 502 passes through the through hole 504 provided in the image forming station 400 was described, but a constitution in which the through hole 504 is not provided and in which the flat cable 502 passes through an open surface at the "upper" portion of the rear side wall portion of the image forming station 400 and is connected to the respective exposure heads 106 may also be employed.

FIG. 8 is a schematic view showing a state in which the image forming station 400 is drawn out of the casing 411 of the image forming apparatus. To the image forming station 400, the flat cables connecting the control substrate 100, the relay substrate 101 and the exposure heads 106 are connected. A state of the exposure heads 106 (106Y, 106M, 106C, 106K) shown in FIG. 8 shows a state in which the exposure heads are disposed at positions where the photosensitive drums 102 of the process cartridges are exposed to light similarly as in FIG. 7. As shown in part (a) of FIG. 1, when an opening operation of the door 410 is performed, the exposure heads 106 move in the upward direction (top surface direction) in the figure by an unshown mechanism and are separately (spaced) form the photosensitive drums 102 of the process cartridges. At that time, the flat cable 502 connected to the flat cable connector 600 of the exposure heads 106 is in a state in which the flat cable 502 is flexed in the "U" direction in the figure.

As shown in FIG. 8, the relay substrate 101 is disposed at the rear side wall portion of the image forming station 400. For that reason, even in a state in which the image forming station 400 is drawn out in the "FR" direction in the figure to the maximum and thus the rear side wall portion comes out of the casing 411 through the opening of the image forming apparatus, the relay substrate 101 remains inside the casing 411 which is inside the opening of the image forming apparatus and is in a state in which the relay substrate 101 is accommodated in the casing 411. In other words, in the state in which the image forming station 400 is drawn out of the casing 411, the relay substrate 101 is positioned upstream of the opening of the image forming apparatus with respect to the drawing-out direction of the image forming station 400 from the casing 411. For that reason, the user is prevented from touching the relay substrate 101 as shown in part (b) of FIG. 11 described above, so that breakage of the relay substrate 101 due to the touch of the user is prevented. Further, as shown in part (b) of FIG. 8, the image forming station 400 can be drawn out to the outside of the image forming apparatus until the rear side wall portion comes out of the image forming apparatus, and therefore, compared with the case of part (b) of FIG. 11, a maintenance property in exchange of the process cartridge, cleaning of the exposure head 106 and the like by the user can be improved. Further, the relay substrate 101 is disposed at the position where the user cannot touch the relay substrate 101, and therefore, there is no need to protect the relay substrate 101 with a cover or the like so that the user cannot touch the relay substrate 101, and thus an increase in cost can be avoided.

Here, the opening formed in the casing 411 defines an upper edge, a lower edge, a right edge and a left edge. In the state in which the image forming station 400 is drawn out, the relay substrate 101 is positioned inside the opening further than at least the upper edge of these edges. That is, "the relay substrate 101 is positioned upstream of the opening with respect to the drawing-out direction of the image forming station 400 from the casing 411" means that the relay substrate 101 is positioned on a side upstream of at least the upper edge of the opening. In other words, the upper edge of the opening formed in the casing 411 is always positioned on a side downstream of the relay substrate 101 with respect to the drawing-out direction of the image forming station 400 from the casing 411. By employing such a constitution, even in the state in which the image forming station 400 is drawn out of the casing 411, a degree of a liability that the user or a service person erroneously touches the relay substrate can be reduced.

As described above, according to this embodiment, when the image forming station is drawn out and then an operation is performed, contact of a person with the relay substrate can be prevented.

Embodiment 2

In the embodiment 1, the embodiment in which the control substrate 100 is disposed at the lower portion of the casing 411 of the image forming apparatus was described. In an embodiment 2, an embodiment in which the control substrate 100 is disposed on a side surface portion of the casing 411 of the image forming apparatus will be described. Incidentally, the structure of the image forming apparatus and the connection constitution between the relay substrate 101 and the exposure head 106 are similar to those in the embodiment 1 and will be omitted from description in this embodiment by adding the same reference numerals or symbols to the same constituent elements.

[Connection Constitution Between Surface and Light Exposure Head]

FIG. 9 is a schematic view for illustrating a connection state of the flat cable 500 connecting the relay substrate 101 and the control substrate 100. The control substrate 100 was disposed on the lower portion of the casing 411 of the image forming apparatus in the embodiment 1 (FIG. 1), but in this embodiment, as shown in FIG. 9, the control substrate 100 is provided on the "left" side wall of the casing 411 (not shown in FIG. 9) of the image forming apparatus in the figure. Further, the control substrate 100 includes the flat cable connector 700 for connecting the flat cable 500.

The flat cable 500 extends from the flat cable connector 501 of the relay substrate 101 in the "D" direction in the figure, and thereafter is folded back at a fold back point 505, and extends in the "L" direction in the figure. Then, the flat cable 500 extends to the left side wall in the casing 411 (not shown in FIG. 9) of the image forming apparatus, and is folded back at a fold back point 701 in the "FR" direction in the figure. The flat cable 500 folded back in the "FR" direction is connected to the flat cable connector 700.

As described above, in the case where the control substrate 100 is provided on the side wall of the casing 411, compared with the case of the above-described embodiment 1, the number of the fold-back points of the flat cable 500 used for connecting the relay substrate 101 and the control substrate 100 can be reduced. As a result, a wiring length of the flat cable 500 can be further shortened, so that the cost can be reduced. Incidentally, in this embodiment, the embodiment in which the control substrate 100 is disposed on the "left" side surface portion of the casing 411 was described, but also in the case where the control substrate 100 is disposed on the "right" side wall (side surface portion) of the casing 411, by similar folding-back of the flat cable, the relay substrate 101 and the control substrate 100 can be connected to each other. Further, this embodiment is also applicable to the case where the control substrate 101 is, for example, provided on the side wall portion of the casing 411 opposing the rear side wall portion of the image forming station 400 on which the relay substrate 101 is provided. At that time, the wiring length of the flat cable 500 connecting the relay substrate 101 and the control substrate 100 can be made shorter than that in the case of this embodiment, but may also be determined in consideration of a length in which an entirety of the image forming station 400 can be drawn out of the casing 411. Incidentally, also in this embodiment, similarly as in the embodiment 1, for that reason, the user is prevented from touching the relay substrate 101, so that breakage of the relay substrate 101 due to the touch of the user is prevented. Further, the image forming station 400 can be drawn out to the outside of the image forming apparatus until the rear side wall portion comes out of the image forming apparatus, and therefore, a maintenance property in exchange of the process cartridge, cleaning of the exposure head 106 and the like by the user can be improved.

As described above, according to this embodiment, when the image forming station is drawn out and then an operation is performed, contact of a person with the relay substrate can be prevented.

Embodiment 3

In the embodiments 1 and 2, generation of the irradiation data corresponding to the surface light emitting elements of the surface emitting element array chips 1 to 29 mounted on the exposure head 106 was carried out by the LED control ASIC 104 provided on the relay substrate 101. In an embodiment 3, an embodiment in which the LED control ASIC 104 is disposed on the control substrate 100 and thus the generation of the irradiation data is carried out by the control substrate 100 will be described. Incidentally, the structure of the image forming apparatus and the connection constitution among the control substrate 100, the relay substrate 101 and the exposure head 106 are similar to those in the embodiments 1 and 2 and will be omitted from description in this embodiment by adding the same reference numerals or symbols to the same constituent elements.

[Control Constitution of Control Substrate, Relay Substrate and Light Exposure Head]

FIG. 10 is a block diagram for illustrating a control constitution of the control substrate 100, the relay substrate 101 and the respective exposure heads 106 (106Y, 106M, 106C, 106K) in this embodiment. The control substrate 100 includes the main CPU 110 for controlling the image formation, the image ASIC 103, the LED control ASIC 104 for generating the irradiation data, and a parallel-serial conversion IC 112 for performing parallel-serial conversion of irradiation data signals. Incidentally, on the control substrate 100, various control circuits for controlling the image formation are provided, but in this embodiment, only the control circuit relating to the control of the exposure heads 106 is described, and other control circuits will be omitted from description.

When the image ASIC 103 receives an image formation instruction from the main CPU 110, the image ASIC 103 outputs, to the LED control ASIC 104, the image data including the pixel data corresponding to the surface light emitting elements of the surface emitting element array chips 1 to 29 mounted on each of the exposure heads 106. The LED control ASIC 104 receives the image data outputted from the image ASIC 103 of the control substrate 100, and on the basis of the received image data, converts the image data into irradiation data corresponding to the respective surface light emitting elements of the surface emitting element array chips 1 to 29 mounted on the exposure heads 106. The parallel serial conversion IC 112 converts the irradiation data signals, converted by the LED control ASIC 104, into high speed serial signals by parallel serial conversion, and sends the high speed serial signals to the relay substrate 101.

The relay substrate 101 includes a serial-parallel conversion IC 114, and the serial-parallel conversion IC 114 is connected to the exposure heads 106Y, 106M, 106C and 106K corresponding to the process cartridges via the flat cables. The high-speed serial signals sent from the control substrate 100 are inputted to the serial-parallel conversion IC 114. The serial-parallel conversion IC 114 converts the high-speed serial signals into parallel signals for driving the exposure heads 106 and then sends the parallel signals to the exposure heads 106. The parallel signals inputted to the exposure heads 106 via the flat cables connected to the relay substrate 101 are inputted to the driving portions 303*a* and

303*b* mounted on the driving substrate 202 of each of the exposure heads 106, and on the basis of the received irradiation data, turning-on control of the surface light emitting elements is carried out.

As described above, the LED control ASIC 104 provided on the relay substrate 101 in the embodiments 1 and is removed and provided on the control substrate 100 in this embodiment, and on the relay substrate 101, the serial-parallel conversion IC 114 smaller in size than the LED control ASIC 104 is provided. As a result, a substrate size of the relay substrate 101 can be further downsized, so that a degree of freedom of the arrangement position of the relay substrate 101 can be improved. Incidentally, also in this embodiment, similarly as in the embodiments 1 and 2, the user is prevented from touching the relay substrate 101, so that breakage of the relay substrate 101 due to the touch of the user is prevented. Further, the image forming station 400 can be drawn out to the outside of the image forming apparatus until the rear side wall portion comes out of the image forming apparatus, and therefore, a maintenance property in exchange of the process cartridge, cleaning of the exposure head 106 and the like by the user can be improved.

As described above, according to this embodiment, when the image forming station is drawn out of the casing and an operation is performed, a degree of a liability that the user or a service person erroneously contacts the relay substrate can be reduced.

According to this embodiment, when the image forming station is drawn out and then an operation is performed, contact of a person with the relay substrate can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-202899 filed on Oct. 29, 2018, which is hereby incorporated by reference herein in its entirety.

What is claimed is:

1. An image forming apparatus comprising:

a drawer unit capable of being drawn out of said image forming apparatus to a front side thereof, wherein said drawer unit comprises:

a photosensitive member, an exposure head configured to expose said photosensitive member, and a relay substrate connected to said exposure head with a cable to relay signal transmitted to said exposure head, wherein said relay substrate is provided outside of an outer wall of a rear side of said drawer unit.

2. An image forming apparatus according to claim 1, wherein said cable is a flexible flat cable.

3. An image forming apparatus according to claim 1, wherein said exposure head is provided above said photosensitive member with respect to a vertical direction.

4. An image forming apparatus according to claim 1, wherein said exposure head includes a plurality of light emitting diodes for emitting light to expose said photosensitive member.

5. An image forming apparatus according to claim 1, wherein said exposure head includes a plurality of organic light emitting diodes for emitting light to expose said photosensitive member.

6. An image forming apparatus according to claim 1, wherein said drawer unit includes:

a left side wall forming an outer wall of a left side of said drawer unit, and a right side wall forming an outer wall of a right side of said drawer unit, wherein a rear end of said left side wall and a rear end of said right side wall are continuous to said outer wall of the rear side of said drawer unit.

7. An image forming apparatus according to claim 6, wherein said left side wall supports one end side of said exposure head with respect to a rotational axis direction of said exposure head, and said right side wall supports the other end side of said exposure head with respect to the rotational axis direction.

8. An image forming apparatus according to claim 7, wherein an opening is formed at the front side of said image forming apparatus such that said drawer unit passes therethrough when said drawer unit is drawn out, and wherein said relay substrate is positioned upstream of said opening with respect to a drawing-out direction in a state in which said drawer unit is drawn out.

9. An image forming apparatus according to claim 1, wherein a through-hole is formed in said outer wall of rear side of said drawer unit, and wherein said relay substrate and said exposure head are connected by said cable via the through-hole.

10. An image forming apparatus according to claim 1, wherein said relay substrate and said exposure head are connected by said cable passing through an upper side of said outer wall of the rear side of said drawer unit with respect to a vertical direction.

11. An image forming apparatus according to claim 1, further comprising an output substrate, provided below said drawer unit mounted in said image forming apparatus with respect to a vertical direction, configured to output a signal for driving said exposure head, wherein said output substrate and said relay substrate are connected by single flexible flat cable.

* * * * *